US011701795B1

(12) United States Patent
Whalen et al.

(10) Patent No.: US 11,701,795 B1
(45) Date of Patent: Jul. 18, 2023

(54) CONCRETE MOLD FORM

(71) Applicants: Joel A. Whalen, Haslett, TX (US); Taylor A. Slate, Ft Worth, TX (US); Robert N. Mills, N. Richland Hills, TX (US); Glenn R. Prewett, Arlington, TX (US); Garrett W. Ollmann, Seattle, WA (US)

(72) Inventors: Joel A. Whalen, Haslett, TX (US); Taylor A. Slate, Ft Worth, TX (US); Robert N. Mills, N. Richland Hills, TX (US); Glenn R. Prewett, Arlington, TX (US); Garrett W. Ollmann, Seattle, WA (US)

(73) Assignee: Hamilton Form Company, Ltd., Ft. Worth, TX (US)

( * ) Notice: Subject to any disclaimer, the term of this patent is extended or adjusted under 35 U.S.C. 154(b) by 483 days.

(21) Appl. No.: 16/792,334

(22) Filed: Feb. 17, 2020

Related U.S. Application Data

(60) Provisional application No. 62/811,555, filed on Feb. 28, 2019, provisional application No. 62/811,442, filed on Feb. 27, 2019.

(51) Int. Cl.

| | |
|---|---|
| ***B28B 7/00*** | (2006.01) |
| ***B28B 23/02*** | (2006.01) |
| ***B28B 7/24*** | (2006.01) |

(52) U.S. Cl.
CPC ..... *B28B 7/0041* (2013.01); *B28B 7/246* (2013.01); *B28B 23/02* (2013.01)

(58) Field of Classification Search
CPC ..... B28B 7/266; B28B 7/0041; B28B 7/246; B28B 23/02
See application file for complete search history.

(56) References Cited

U.S. PATENT DOCUMENTS

| | | | | |
|---|---|---|---|---|
| 3,645,490 | A | 2/1972 | Beasley | |
| 3,832,118 | A * | 8/1974 | Mitchell | B28B 7/10 249/161 |
| 3,963,395 | A * | 6/1976 | Bourdo | B29C 44/1233 425/441 |
| 4,156,517 | A | 5/1979 | Schmucker et al. | |
| 6,086,350 | A | 7/2000 | Del Monte | |

(Continued)

FOREIGN PATENT DOCUMENTS

| | | |
|---|---|---|
| CN | 108274596 | 7/2018 |
| DE | 7344616 | 5/1974 |

(Continued)

*Primary Examiner* — Jacob T Minskey
*Assistant Examiner* — S. Behrooz Ghorishi
(74) *Attorney, Agent, or Firm* — Law Office of William Gustavson, PC

(57) ABSTRACT

A concrete mold form (10) is provided to form concrete products such as concrete bridge girder (12). The form (10) has first and second side forms (14, 16) which are supported on carriages (22) riding on tracks (24) for moving the side forms (14, 16) between a closed position to cast the product and an open position to allow the cast product to be removed. At least one of the carriages (22) is a powered carriage (22P, 22M) which rotates a roller (28, 70) engaging the track with a hydraulic motor (38) to move the side form between the closed and open positions.

18 Claims, 11 Drawing Sheets

(56) References Cited

U.S. PATENT DOCUMENTS

| | | | | |
|---|---|---|---|---|
| 6,106,749 | A * | 8/2000 | Adly | B28B 21/26<br>425/150 |
| 2002/0183148 | A1* | 12/2002 | Goryca | B65G 43/02<br>474/102 |
| 2006/0011802 | A1 | 1/2006 | Di Cesare | |
| 2018/0169897 | A1 | 6/2018 | Jennings | |

FOREIGN PATENT DOCUMENTS

| | | |
|---|---|---|
| DE | 4426192 | 1/1996 |
| JP | 2007196546 | 8/2007 |

* cited by examiner

CONCRETE MOLD FORM

CROSS REFERENCE TO RELATED APPLICATIONS

This application claims priority from U.S. Provisional Patent Application Ser. Nos. 62/811,555 filed Feb. 28, 2019 and 62/811,422 filed Feb. 27, 2019.

TECHNICAL FIELD

This invention relates to a concrete mold form, in particular to a form for casting concrete bridge girders.

BACKGROUND OF THE INVENTION

Large concrete girders, particularly bridge girders, are cast in forms which are of sufficient length to form the girders, for example 520 feet. To contain the concrete poured into the mold to form the girder and to provide the proper shape to the girder, the form has contoured first and second side forms extending the entire length of the form to form the sides of the girder, a soffit extending between the side forms at their bottoms to space the side forms apart and form the bottom of the girder and end walls at the desired position along the form to define the length of the girder.

Once the girder has cured sufficiently, the side forms must be moved away from the cast girder to allow it to be removed from the form. One technique for achieving this movement is to mount each side form on a plurality of wheeled carriages supported on parallel tracks extending away from the mold, and sliding the carriages and side form away from the cast girder along the tracks. The movement of the side forms is typically performed by cranes positioned at the molding site.

The casting process is an expensive and complicated procedure and it is desirable to develop techniques to reduce the cost and increase efficiency in the casting process.

SUMMARY OF THE INVENTION

In accordance with one aspect of the present invention, a concrete form is provided having at least a first side form. The form includes a plurality of parallel tracks with a carriage movable along each track, the first side form being supported on the carriages. The carriages have wheels engaging the tracks. At least one of the carriages has a mechanism to rotate at least one of the wheels of the carriage to move the carriages and first side form along the tracks between a first, molding position to a second, release position.

In accordance with another aspect of the present invention, the mechanism to rotate the at least one wheel of the carriage is a hydraulic motor.

In accordance with another aspect of the present invention, the hydraulic motor rotates the wheel through a chain drive.

In accordance with another aspect of the present invention, a spring is provided to urge the at least one wheel into engagement with the track.

In accordance with another aspect of the present invention, the form includes 21 parallel tracks, at least four of the carriages, and preferably eight of the carriages, movable along the tracks having a mechanism to rotate at least one of the wheels of the carriage.

In accordance with another aspect of the present invention, the form is about 520 feet in length, with tracks spaced every 25 feet.

BRIEF DESCRIPTION OF THE DRAWINGS

A more complete understanding of the invention and its advantages will be apparent from the following Detailed Description, taken in conjunction with the accompanying Drawings, in which.

DETAILED DESCRIPTION

Figure 1A:
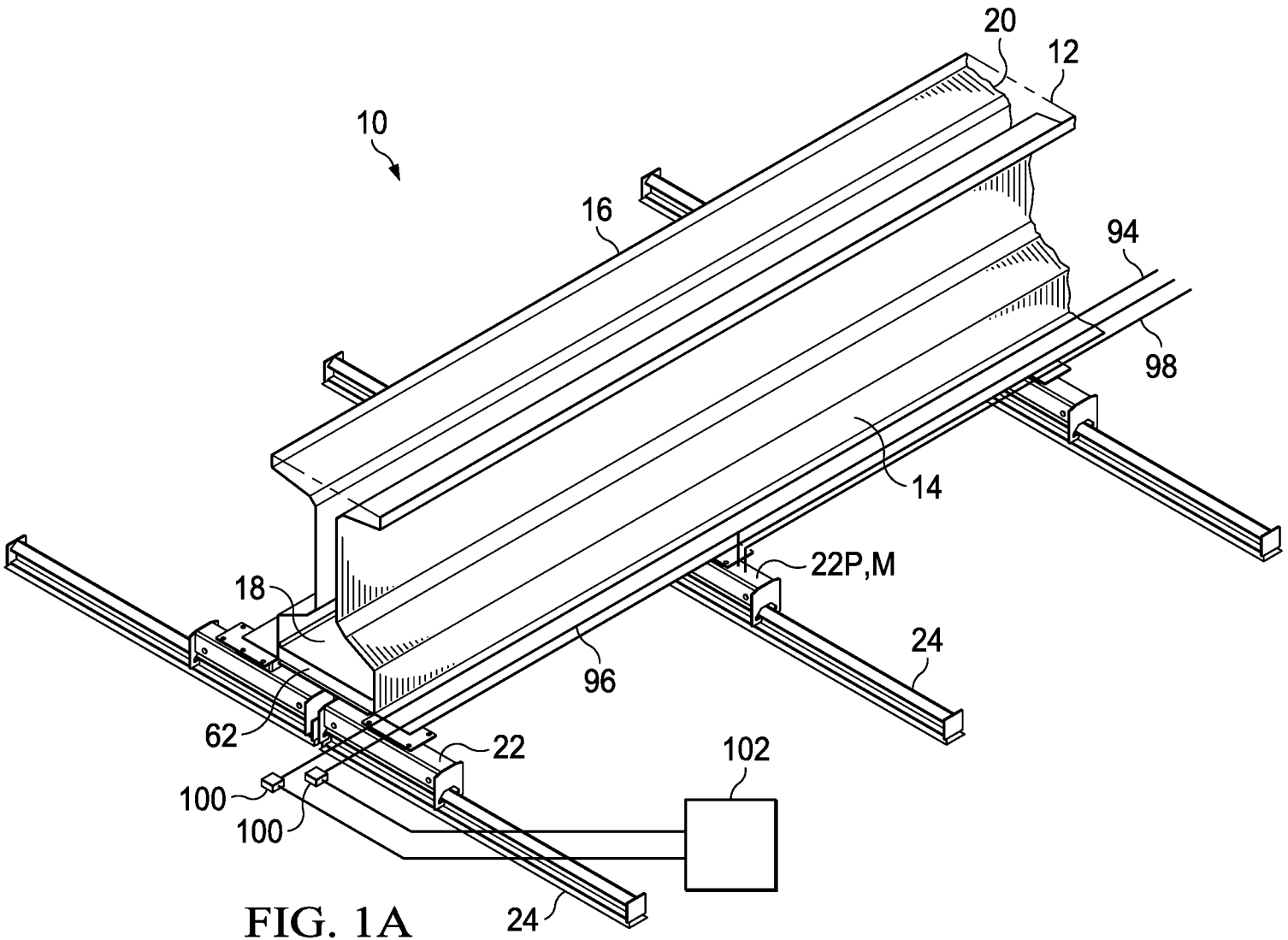
FIGS. 1A and 1B are illustrations of one end of a form made in accordance with a first embodiment of the present invention in the closed position and open position, respectively.
Figure 1B:
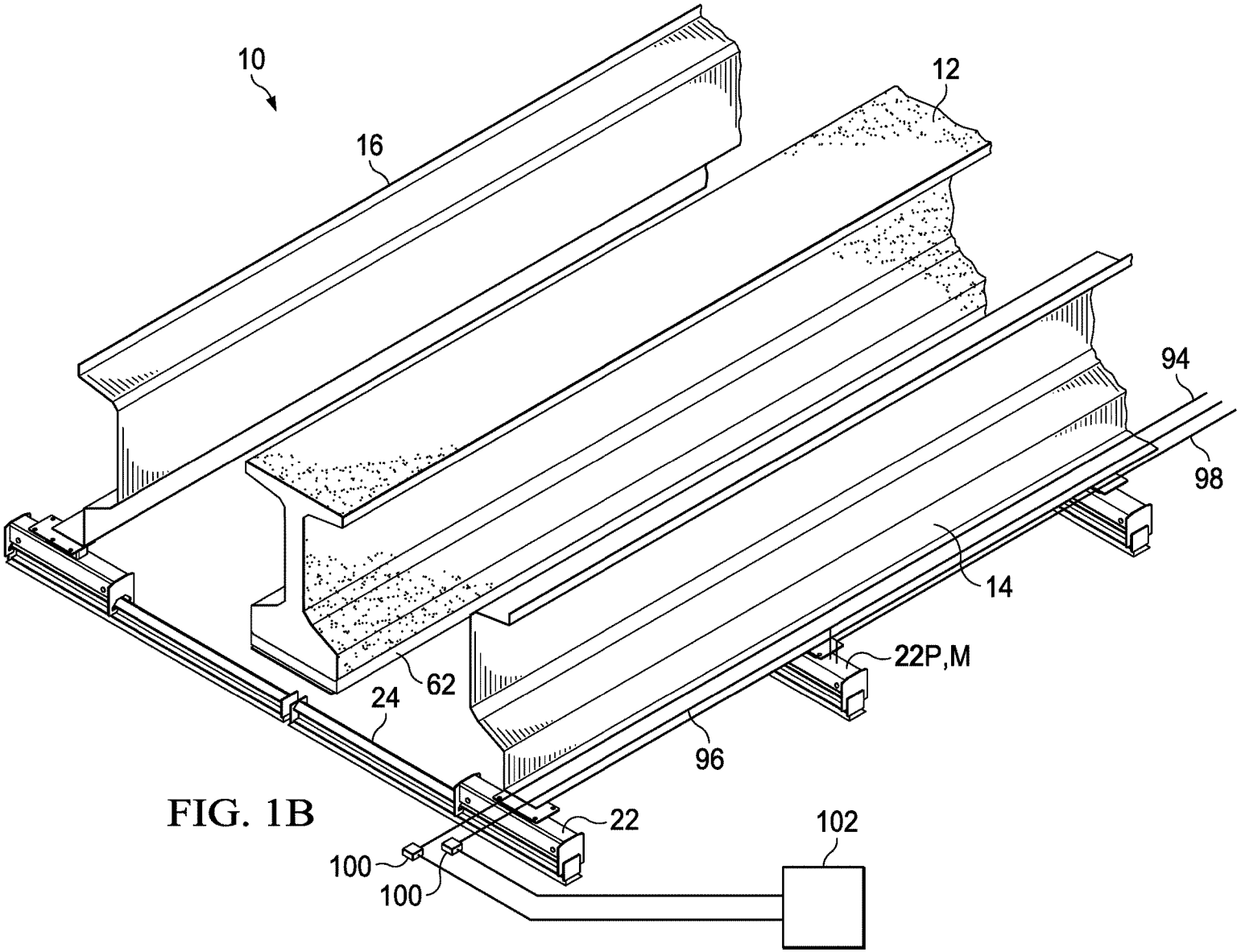
Figure 2A:
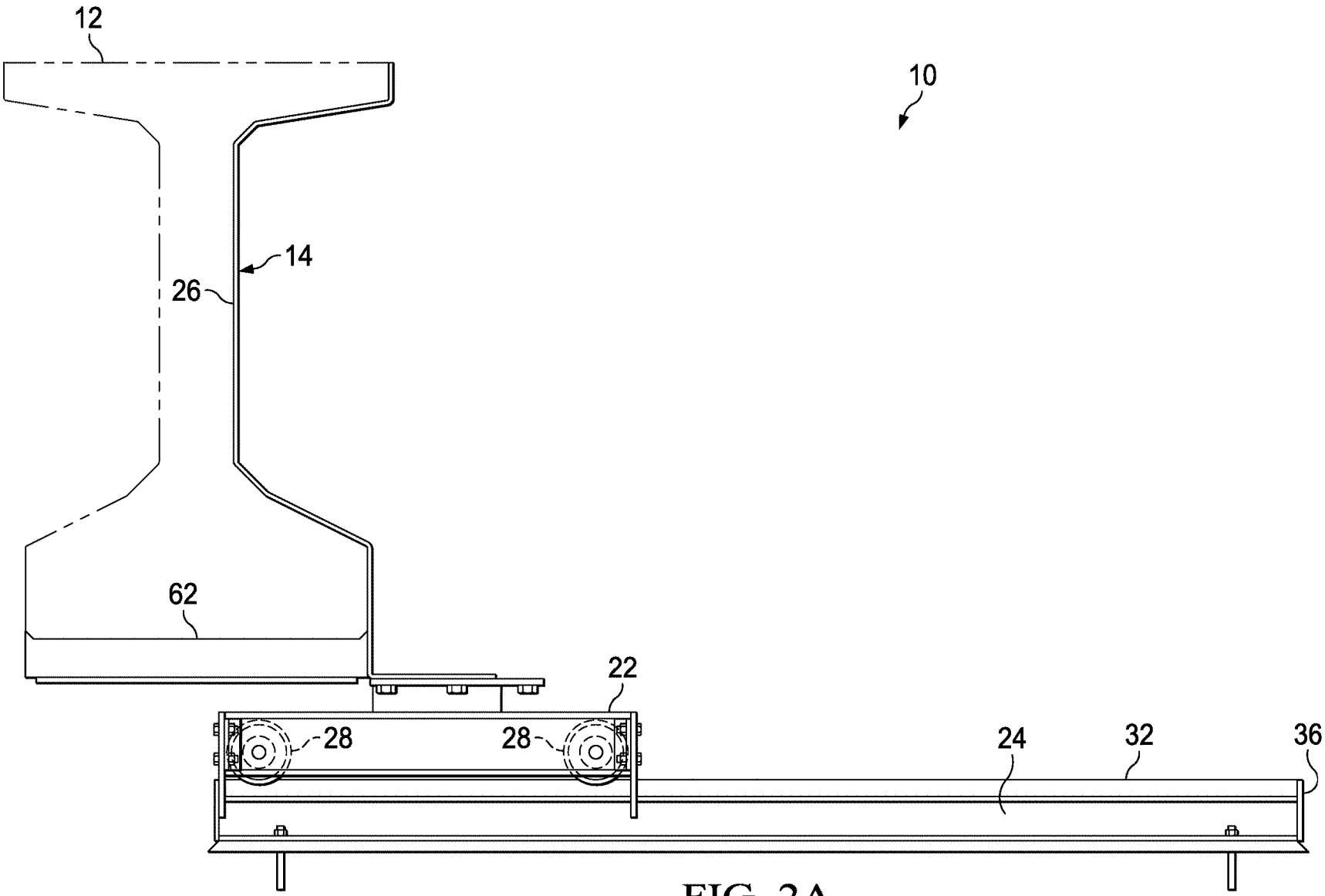
FIG. 2A is a view of the first side form of FIG. 1A in the closed position to form the casting.
Figure 2B:
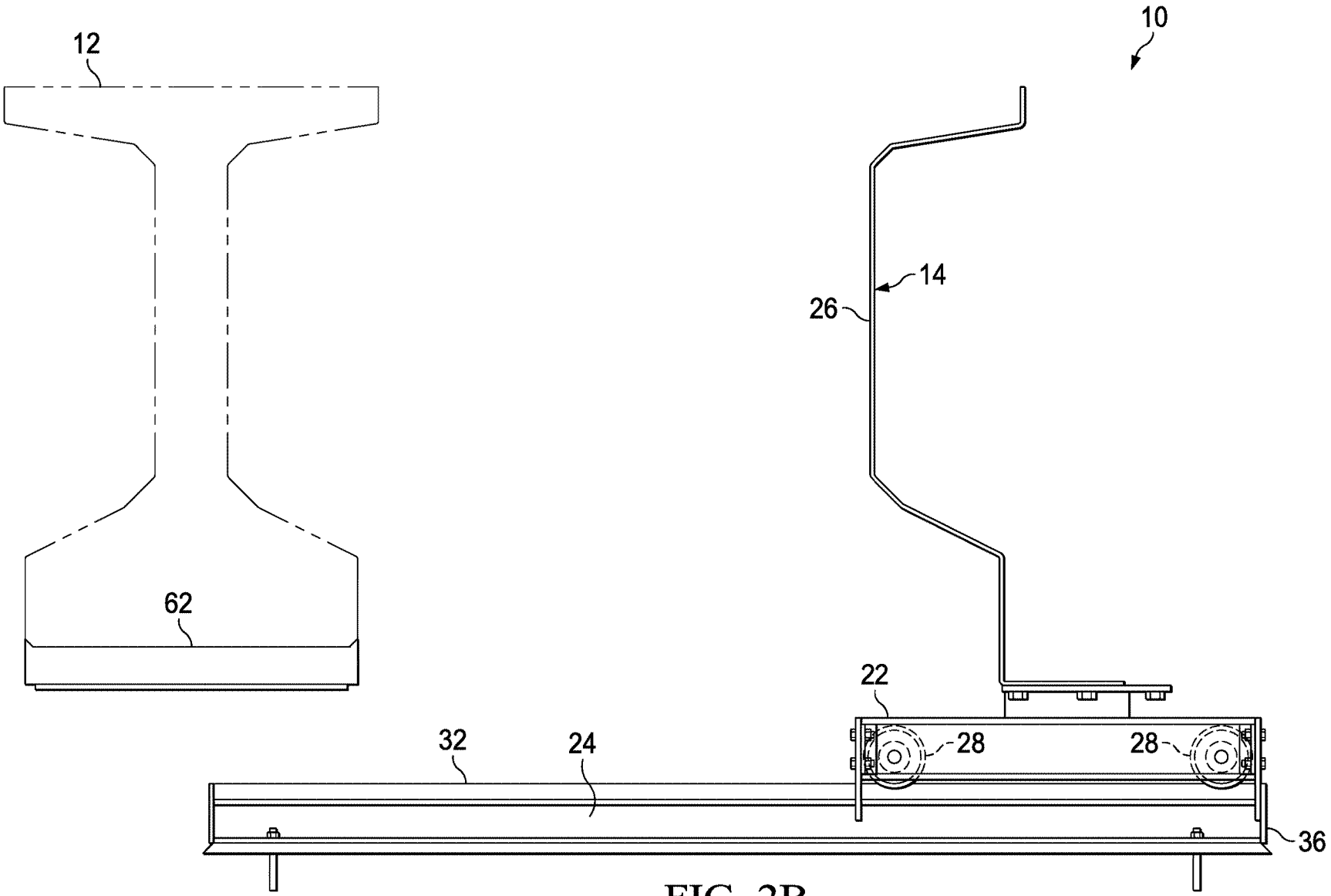
FIG. 2B is a view of the first side form of FIG. 1B in the opened position to release the casting.

With reference now to the figures, FIGS. 1A and 1B illustrate a concrete mold form 10 made in accordance with the teaching of the present invention. Form 10 is used to mold concrete structures such as concrete bridge girder 12. The form 10 defines a cavity in which to pour the concrete and form the desired final product, with the cavity defined by first and second side forms 14 and 16, a soffit 62 and end walls 18 and 20. The side forms 14 and 16 are moveable between a closed position as seen in FIG. 1A and an open position as shown in FIG. 1B, as will be described hereinafter, to mold the bridge girder 12 in the closed position and allow the cast bridge girder 12 to be removed in the open position.

The length of the bridge girder 12 is defined by the position of the end walls 18 and 20 in the form 10 and the end walls 18 and 20 can be placed in the form 10 in any location to cast the proper length. The form 10 can be, for example, 520 feet in length. Multiple bridge girders 12 can be formed in a single pour by using multiple sets of end walls 18 and 20 in the form 10, set at the desired spacing. For example, a 520 foot long form 10 could be used to cast two 250 foot long bridge girders 12 simultaneously. Typically, multiple girders 12 of length of 50 feet to 80 feet are cast in a single pour. The width of the base of the bridge girder 12 is set by the width of the soffit 62 and the profile by the shape of the side forms 14 and 16, as seen in FIGS. 1A, 1B, 2A, 2B and 3. When casting, the first and second side forms 14 and 16 are mechanically tied together in the closed position to withstand the pressures of the casting process. The inner surface 26, or skin, of the first side form 14 is in contact with the concrete poured into the form 10 and defines the profile of one side of the finished cast product, in this case bridge girder 12. Vibration units are also commonly used in the form 10 to eliminate air pockets in the cast product.

Figure 6:
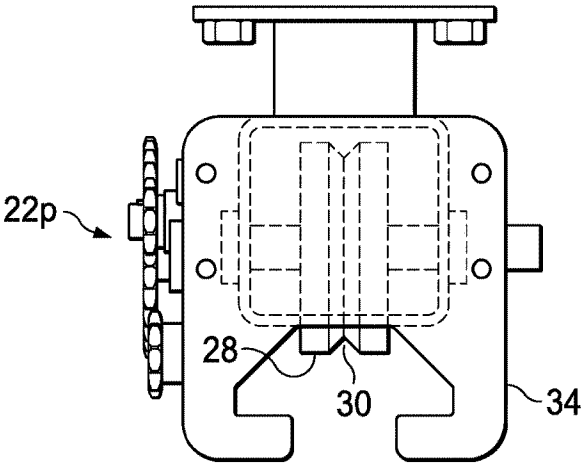
FIG. 6 is an end view of the powered carriage of FIG. 4.

As seen in FIGS. 1A, 1B, 2A and 2B, the first side form 14 is supported by and for motion between the open and closed positions on wheeled carriages 22 running on tracks 24. All of the carriages 22 have two grooved rollers 28 riding on the tracks 24, as seen in FIG. 6. The rollers 28 define grooves 30 which engage an angle member 32 on the top of the tracks 24 to restrict the carriage 22 to linear motion along the track 24. An anti-tipping end plate 34 is mounted at each end of the carriages 22 to limit tipping of the first side form 14. Stop plates 36 are mounted at the ends of each track 24 to limit the travel of the first side form 14 along tracks 24.

Figure 3:
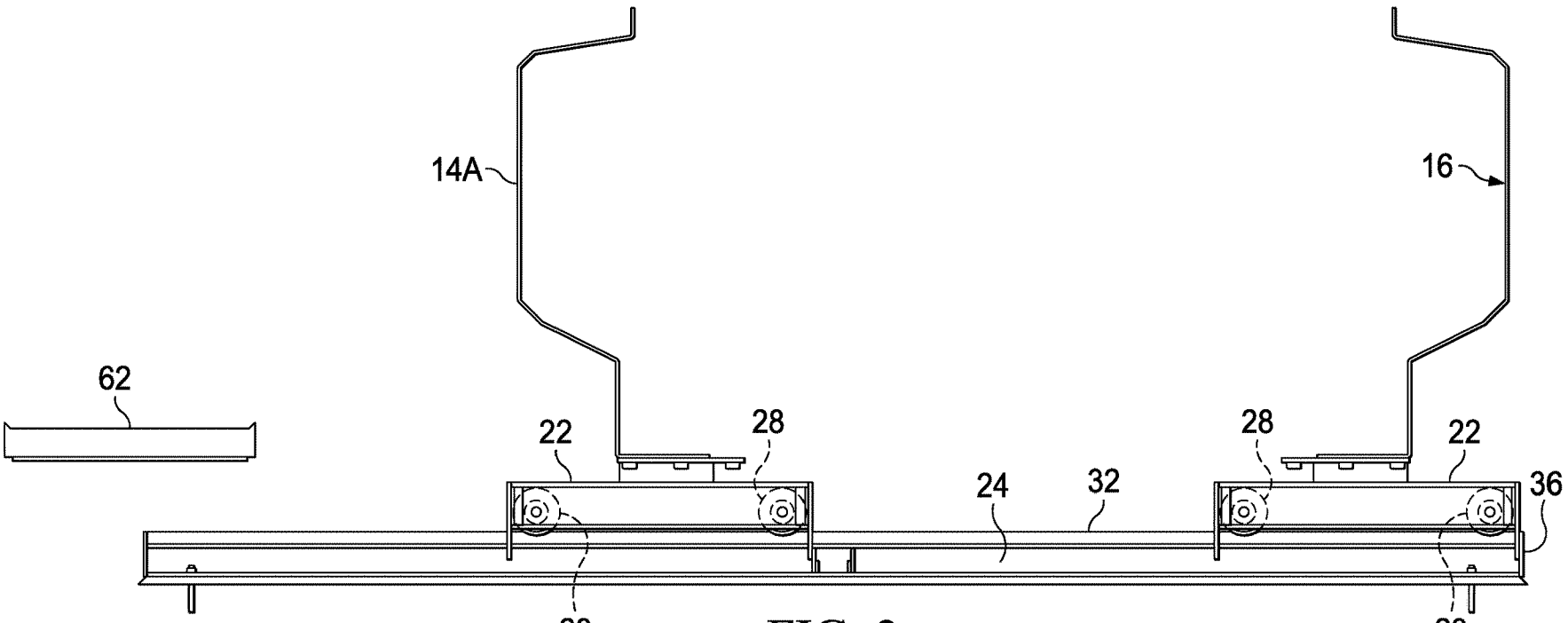
FIG. 3 is a view of the second side form of FIG. 1A in the closed position to form the casting and a first side form from another form in the open position.

FIG. 3 illustrates the second side form 16 in the closed position. Second side form 16 also is mounted on wheeled carriages 22 running on tracks 24. The inner surface 26, or skin, of the second side form 16 is also in contact with the concrete poured into the form 10 and defines the profile of the other side of the finished cast product, in this case bridge girder 12. FIG. 3 illustrates another first side form 14A which can be part of a second form 10 sharing the same tracks 24.

Figure 4:
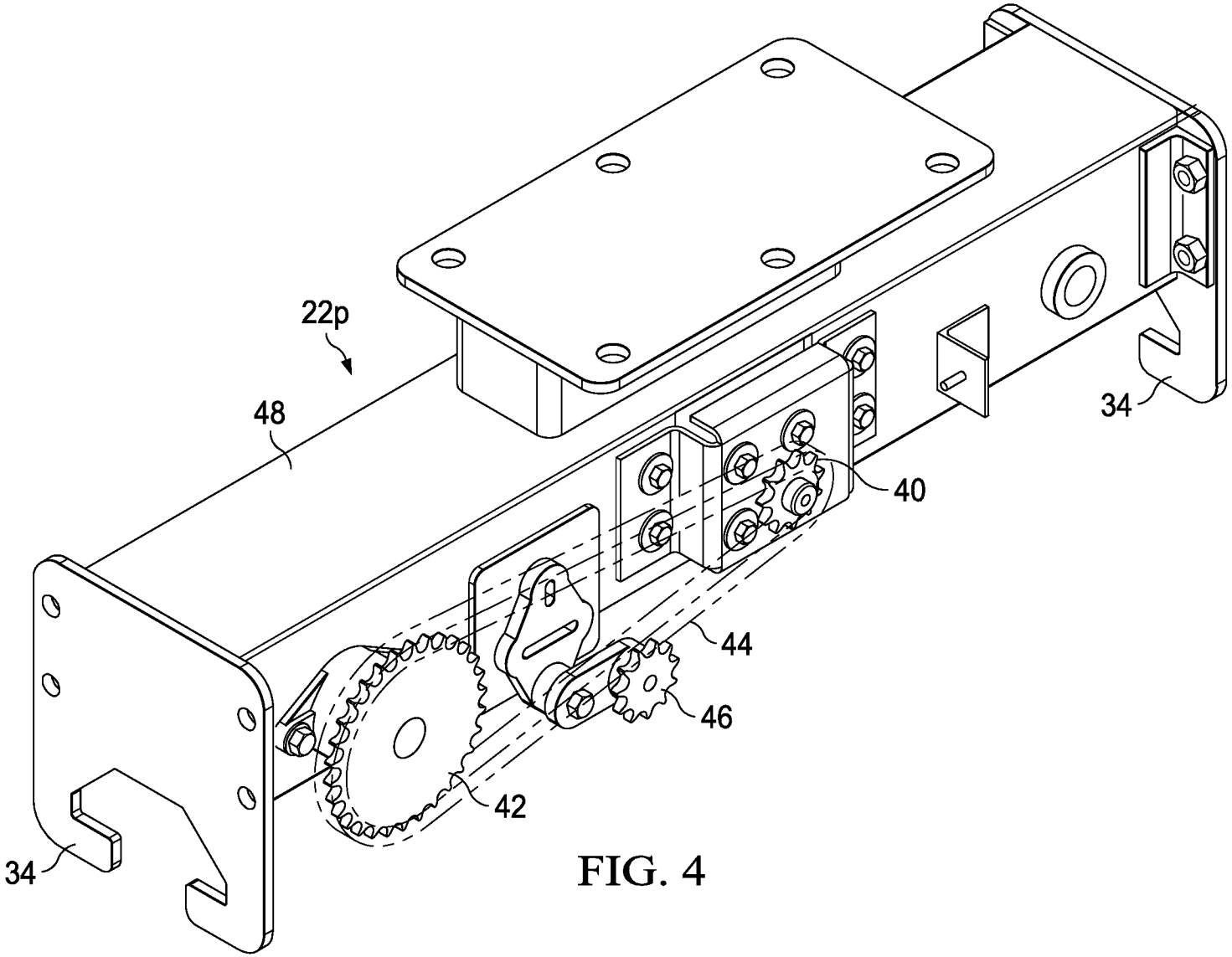
FIG. 4 is a perspective view of a powered carriage used in the form.
Figure 5:
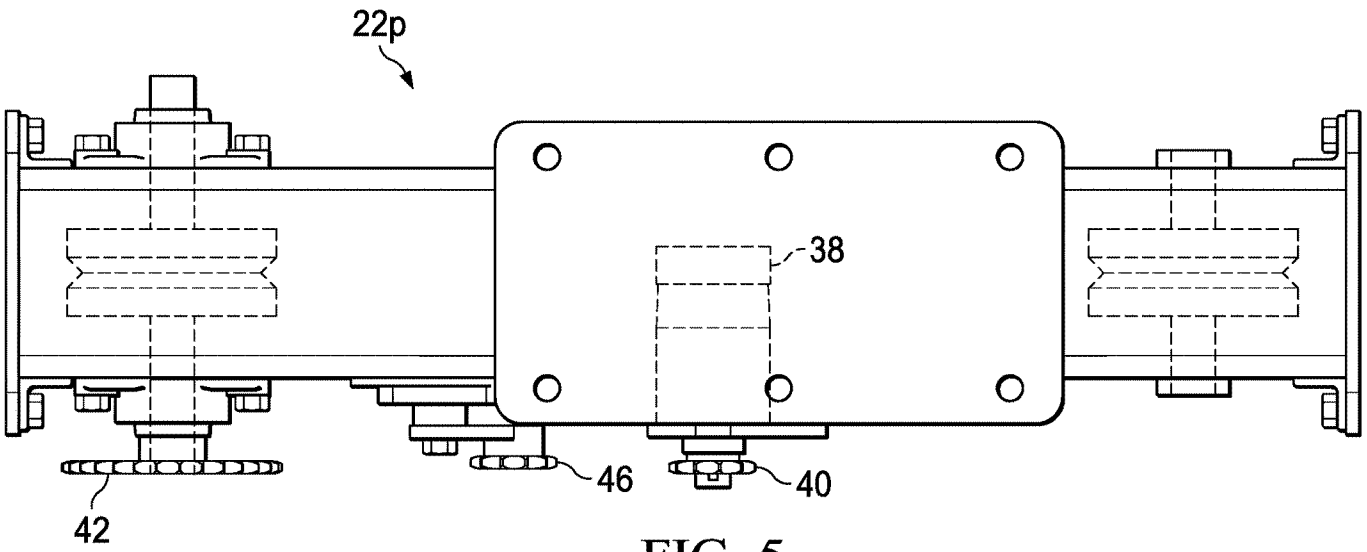
FIG. 5 is a plan view of the powered carriage of FIG. 4.

As can be seen in FIGS. 4-6, select carriages 22, namely carriages 22P, are powered by hydraulic motors 38 mounted directly on the carriages 22P to move the first and second side forms 14 and 16 between the opened and closed positions. As seen in FIGS. 4-6, the hydraulic motor 38 rotates a gear 40 attached to the drive shaft of the motor 38, which, in turn, drives a gear 42 attached to one of the rollers 28 of carriage 22P through drive chain 44. A tensioning device 46 can be used to maintain proper tension in the chain 44.

The carriages 22 include a tube 48, typically of steel, which mount the rollers 28. In the powered carriages 22P, the hydraulic motor 38 can be completely mounted within the tube 48, with only its drive shaft with gear 40 extending outside the tube 48 to minimize clutter and protect the motor 38 itself from damage.

Figure 7:
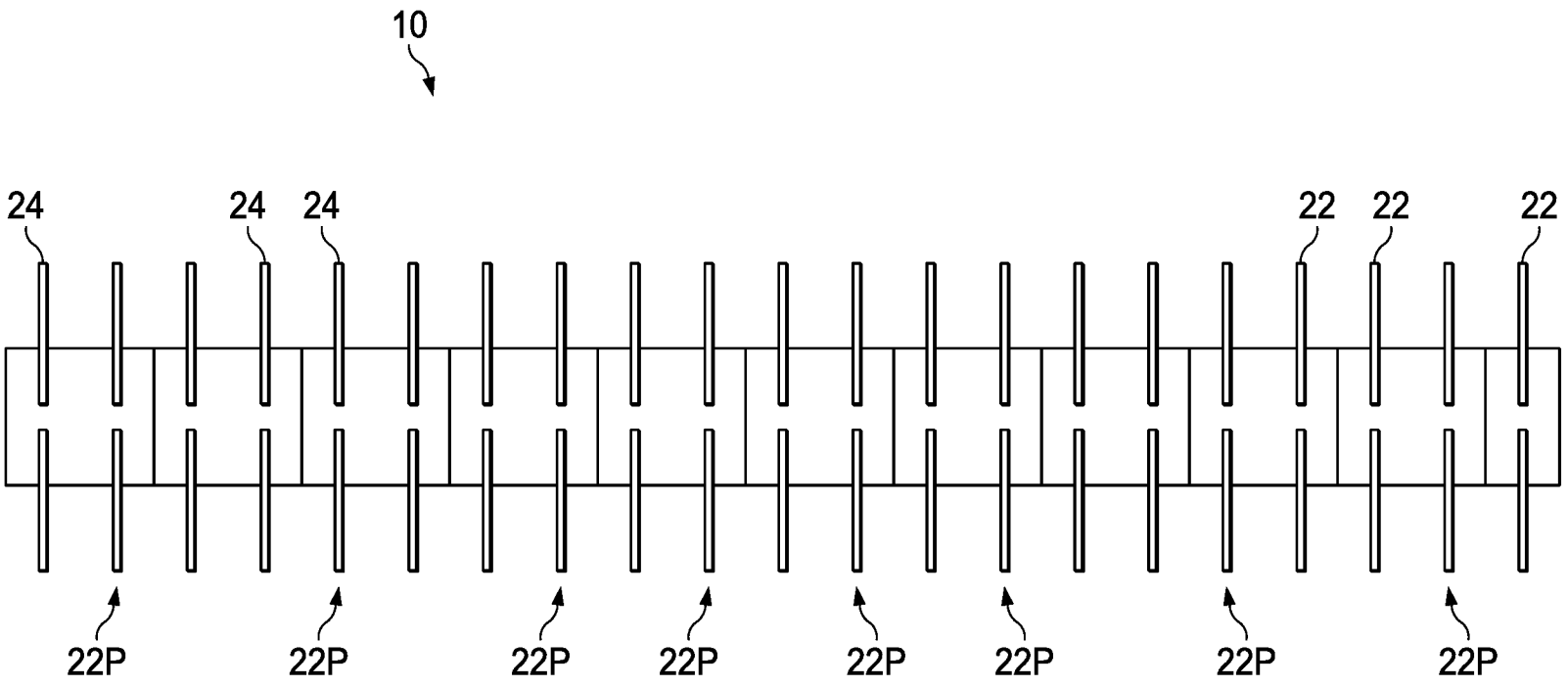
FIG. 7 is an illustration of the distribution of carriages in the form.

FIG. 7 illustrates a typical configuration for a form 10 of length 520 feet. Twenty one parallel tracks 24 would be used to support each of the side forms 14 and 16. Of the twenty one carriages 22 used to support each side form, eight would be powered carriages 22P. By powering the carriages 22P simultaneously on a given side form, the side form can be moved smoothly and linearly between the open and closed positions. Each of the side forms 14 and 16 can be constructed of ten 50 foot long sections and one 20 foot section, with tracks 24 spaced at 25 foot intervals. By positioning the outermost track at one end of the side form 12½ feet from the end of the form 10, each 50 foot long section will be supported by two tracks 24. The 20 foot section would be at the opposite end of the side form and would be supported by a single track 7½ feet from the end. For twenty one tracks 24, counting tracks from one end of the side form to the other, the powered carriages 22P would be on the 2nd, $5^{th}$, $8^{th}$, $10^{th}$, $12^{th}$, $14^{th}$, $17^{th}$ and $20^{th}$ tracks 24. The distance between open and closed positions can be about 3 to 4 feet, or whatever distance is necessary to allow removal of the cast product.

Any number of powered carriages can be used on each side form For example, if four powered carriages 22P are used on each side form, for twenty one tracks 24, counting tracks from one end of the side form to the other, the powered carriages 22P would be on the 2nd, $8^{th}$, $14^{th}$ and $20^{th}$ tracks 24. The number of drive carriages can vary and is influenced by a number of factors such as quality of track installation, weight of forming, incidental loading, etc. A fundamental factor is that powered carriages 22P should be fairly evenly distributed along the length of the form 10.

Figure 8:
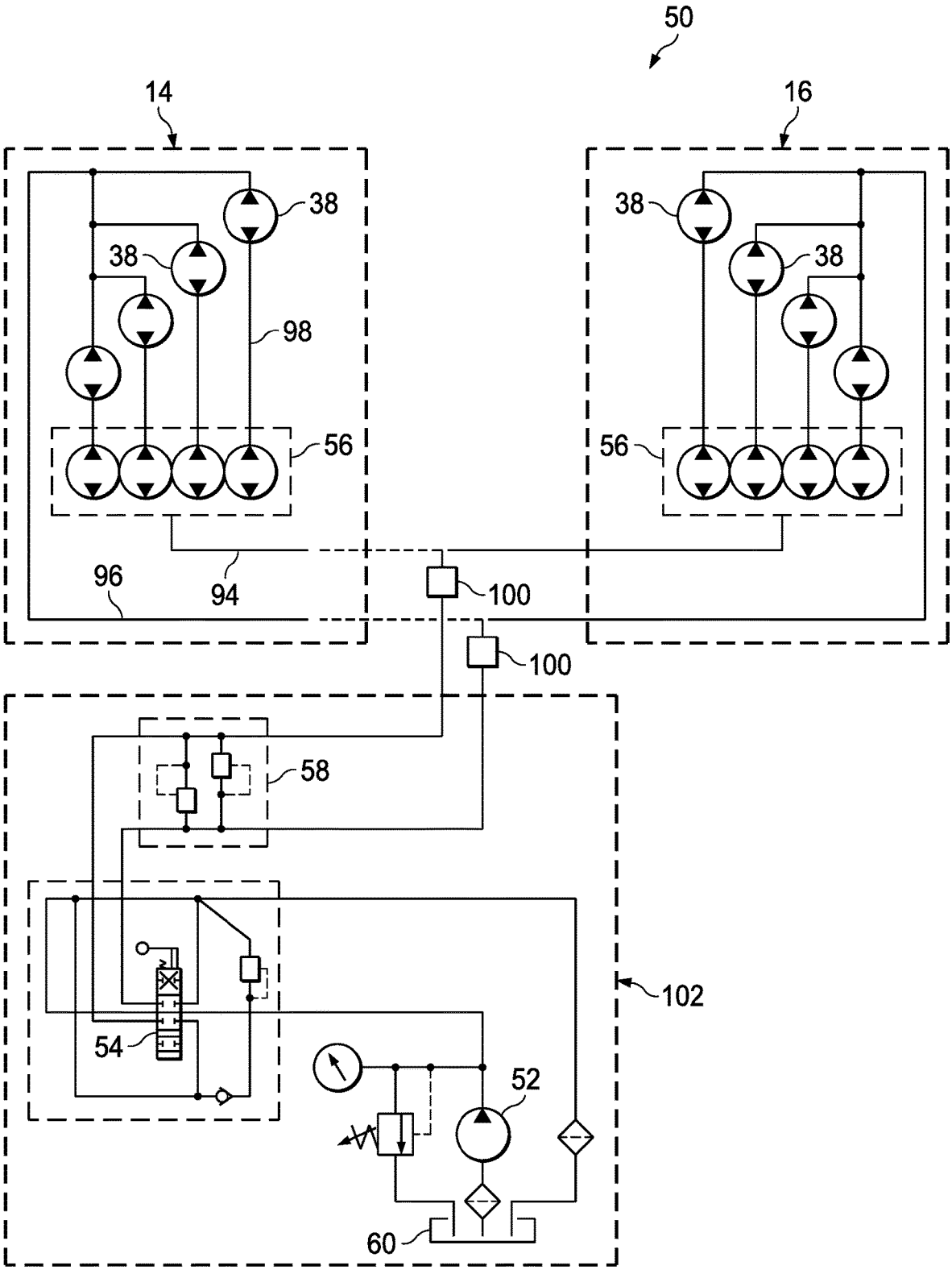
FIG. 8 is a schematic of the hydraulic circuit used to operate the hydraulic motors on the powered carriages to move the side forms between open and closed positions.

FIG. 8 illustrates a schematic of a hydraulic circuit 50 which can be used to move the side forms 14 and 16 between the open and closed positions. The circuit 50 includes a hydraulic pump 52 which provides pressurized fluid though a control valve 54 to flow dividers 56 and to each of the hydraulic motors 38(the circuit 50 illustrates a circuit using four powered carriages 22P on each side form, but eight powered carriages can be accommodated by adding the additional motors 38 and flow dividers 56 as required). Normally, connections are made only to the motors 38 on one of the side forms at a time. By operating the control valve 54, an operator can move the side form between the open and closed positions. If desired, all the motors 38 can be connected at once to simultaneously open and close both the side forms 14 and 16. A pressure relief valve 58 is provided to prevent over pressure on the pump 52 and a sump 60 is provided for returning fluid.

An advantage of the present invention is most of the hydraulic hoses and lines and equipment needed to operate the powered carriages 22P are mounted on the side forms and move with the side forms, thus acting to eliminate trip hazards of exposed hydraulic motors and hydraulic hoses. As seen in FIGS. 1A, 1B and 8, the pump 52, control valve 54, pressure relief valve 58 and sump 60 can be mounted on a portable cart 102 positionable at the first end of the side form 14 or 16 to be moved. A hydraulic line 94 extends along the side form from the first end of the side form to the flow divider or dividers 56, usually mounted along the side form. A Hydraulic line 96 extends along the side form also from the first end of the side form to one side of the closest motor 38 in the powered carriage 22P. Line 96 then continues to extend along the side form to one side of the rest of the motors 38 used on the side form. A hydraulic line 98 extends along the side form back from the flow divider or dividers 56 to the other side of all of the motors 38. Connecters 100 connect the lines 94 and 96 to the cart 102 to provide hydraulic fluid to drive the motors 38 simultaneously in either direction. All the lines 94, 96 and 98 extend along the side form and thus move with the side form to eliminate hazards of lose lines.

Figure 9:
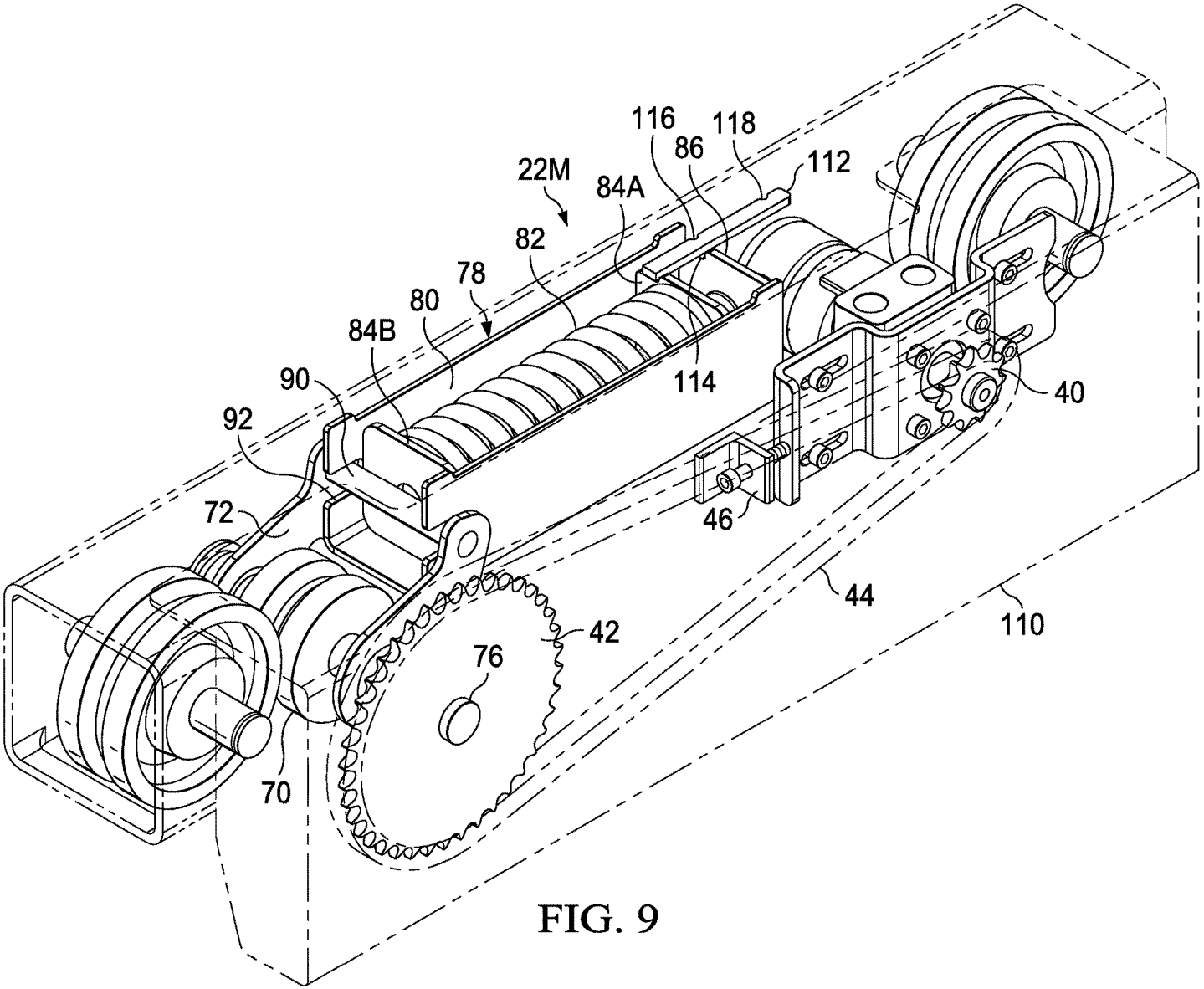
FIG. 9 is a perspective view of a modified powered carriage used in the form.
Figure 10:
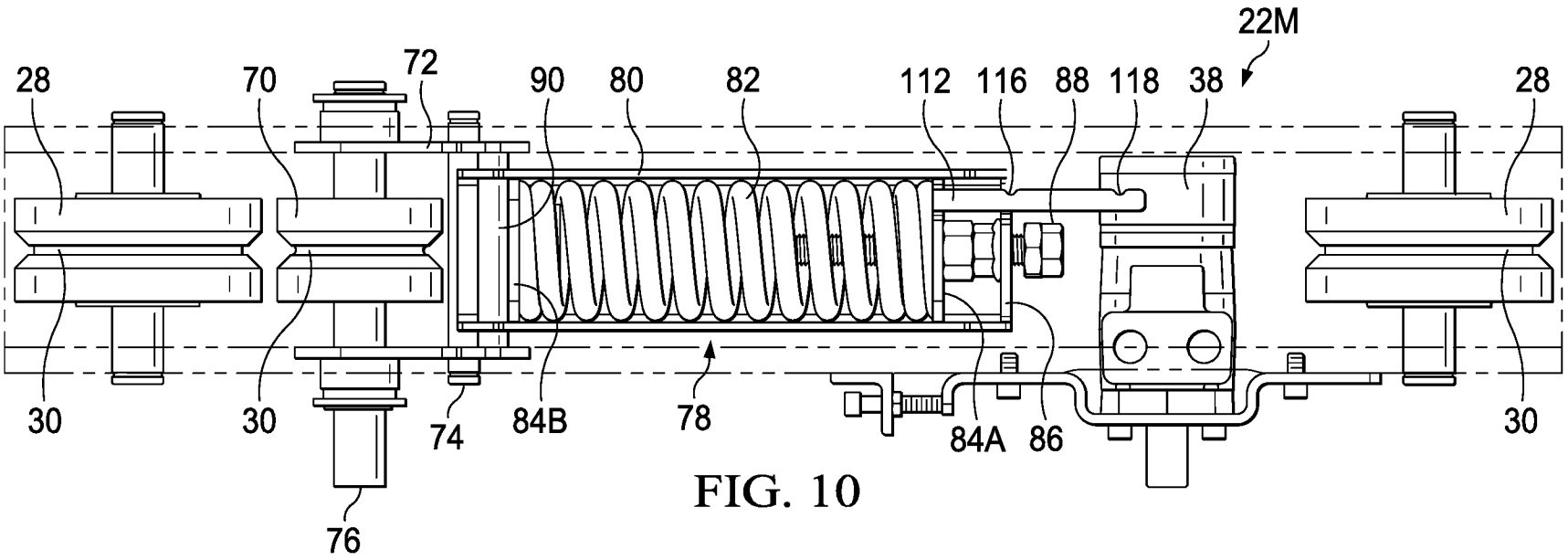
FIG. 10 is a top view of the modified powered carriage.
Figure 11:
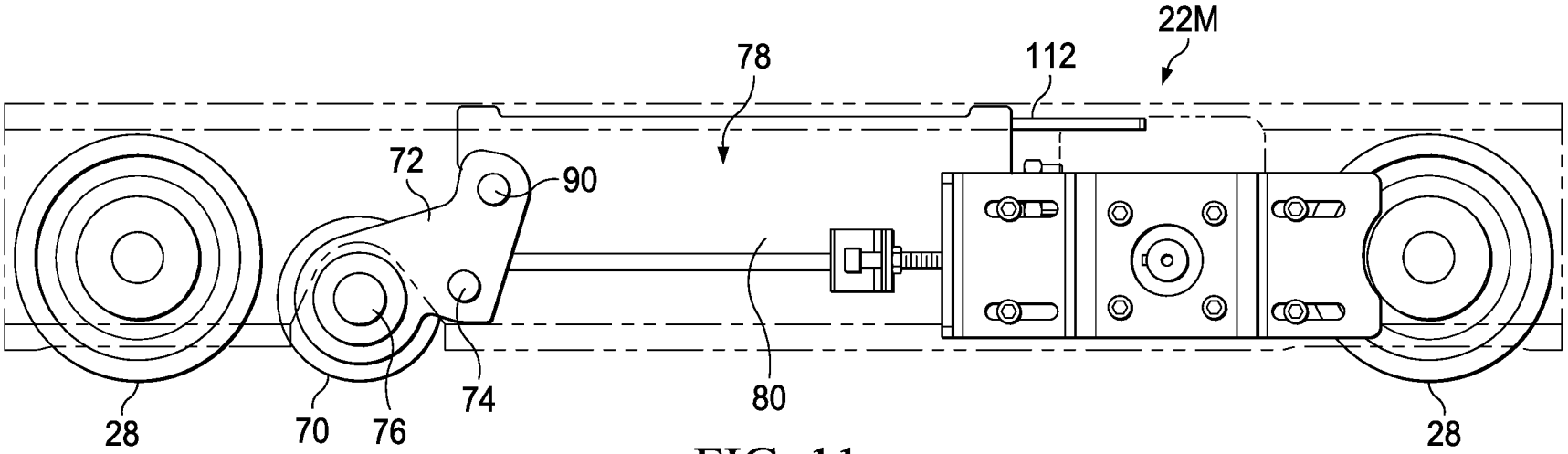
FIG. 11 is a side view of the modified powered carriage.

FIGS. 9-11 illustrate a modified powered carriage 22M that can replace powered carriages 22P. In powered carriage 22M the rollers 28 are not powered, and a third, drive roller 70 is employed, driven by hydraulic motor 38 through drive chain 44. A wheel bracket 72 is pivotally mounted to the tube 48 by a pivot pin 74. The drive roller 70 is mounted to the wheel bracket 72 by drive shaft 76. A spring assembly 78 within tube 48 acts on the wheel bracket 72 to urge the drive roller 70 against the angle member 32 and track 24 with sufficient force to allow movement of the forms 14 and 16 when the drive rollers 70 are driven by the hydraulic motors 38.

The spring assembly 78 includes a spring guide 80 fixed in the tube 48. A spring 82 lies within the spring guide 80 between spring seats 84A and 84B. A spring stop 86 forms one end of the spring guide 80 and receives a bolt 88 to tension the spring 82 by spacing the proximate spring seat 84A a selected distance from the spring stop 86. The spring seat 84B adjacent the wheel bracket 72 bears against a contact bar 90 on the wheel bracket 72 to pivot the wheel bracket 72 about pivot pin 74 and urge the drive roller 70 against the angle member 32. The spring guide 80 has notches 92 in its end near wheel bracket 72 to permit the contact bar 90 to bear against the spring seat 84B and also guide the contact bar 90.

A spring gauge 112 is mounted to spring seat 84A and extends toward the hydraulic motor 38 through a cut out 114 in spring stop 86. Spring gauge 112 has notches 116 and 118 along its length which are visible from outside the tube 48 through an aperture in the side of the tube 48. Notch 116 indicates minimum spring compression and notch 118 indicates maximum spring compression. By turning bolt 88, the compression of the spring 82 can be changed and the position of notches 116 and 118 will move relative a point fixed on the tube 48, for example an edge of the aperture in tube 48, allowing the operator to select minimum or maximum compression of the spring or an intermediate compression to assure proper frictional engagement between the drive roller 70 and track 24 for reliable operation.

A housing 110 can be mounted over the gears 40 and 42 and chain 44 for safety, as shown in phantom line in FIG. 9.

The use of powered carriages 22P and 22M has significant advantages in moving the side forms 14 and 16 between open and closed positions. It is no longer necessary to use a crane to move the side forms. Further, the use of multiple powered carriages 22P and 22M reduces risk of skewing the motion of side forms 14 and 16 in motion. Also, the addition of the hydraulic motors 38, gears 40 and 42, lines 94, 96, and 98 and chains 44 change the configuration of the mold very little, preventing clutter. Further, powered carriages 22P and 22M can be retrofitted to existing unpowered molds to take advantage of the improvements. While hydraulic motors 38 are believed most suitable, the hydraulic motors could be substituted for by electric motors or other suitable drive mechanism.

While several embodiments of the present invention have been illustrated in the accompanying drawings and described in the foregoing Detailed Description, it will be understood that the invention is not limited to the embodiments disclosed, but is capable of numerous rearrangements, modifications and substitutions of parts and elements without departing from the scope and spirit of the invention.

The invention claimed is:

1. A mold form for forming a molded product, comprising:

a first side form;

a plurality of parallel tracks;

a plurality of carriages, each carriage movable along a track, the first side form being supported on the carriages, each carriage having at least one wheel engaging the track and at least one of the carriages having a drive wheel;

a drive mechanism to rotate the drive wheel on the at least one of the carriages to move the carriages and first side form along the tracks between a first, molding position to a second, release position, the drive mechanism including a spring to urge the drive wheel into engagement with the track, the drive mechanism further including a spring guide mounted within the at least one of the carriages, the spring supported within the spring guide, a wheel bracket pivotally mounted to the at least one of the carriages and supporting the drive wheel for rotation, a first spring seat at a first end of the spring, a second spring seat at a second end of the spring, a spring stop at an end of the spring guide engaging the first spring seat and a contact bar engaging the second spring seat and the wheel bracket, the spring acting between the spring stop and the contact bar to pivot the wheel bracket to force the drive wheel into engagement with the track.

2. The mold form of claim 1 wherein the drive mechanism to rotate the drive wheel on the at least one of the carriages is a hydraulic motor.

3. The mold form of claim 2 wherein the hydraulic motor rotates the drive wheel through a chain drive.

4. The mold form of claim 2 having a plurality of said at least one of the carriages, and further comprising a hydraulic circuit to simultaneously provide hydraulic fluid to said plurality of said at least one of the carriages.

5. The mold form of claim 2 wherein the at least one of the carriages is formed of a tube, the hydraulic motor mounted within the tube.

6. The mold form of claim 2 further comprising hydraulic lines mounted along the first side form to power the hydraulic motor.

7. The mold form of claim 1 wherein the mold form includes 21 parallel tracks, at least four of the carriages movable along the tracks having the drive mechanism to rotate a drive wheel of said at least four carriages.

8. The mold form of claim 1 wherein the mold form is about 520 feet in length, with tracks spaced every 25 feet.

9. The mold form of claim 1 further including an adjustment mechanism to adjust the spring force urging the drive wheel into engagement with the track.

10. The mold form of claim 9 further including a spring gauge to indicate the spring force.

11. The mold form of claim 1 wherein said at least one carriage has two support wheels and the drive wheel.

12. A mold form for forming a molded product, comprising:

a first side form;

a plurality of parallel tracks;

a plurality of carriages, each carriage movable along a track, the first side form being supported on the carriages, each carriage having at least one wheel engaging the track and at least one of the carriages having a drive wheel;

a hydraulic motor to rotate the drive wheel on the at least one of the carriages to move the carriages and first side form along the tracks between a first, molding position to a second, release position, hydraulic lines being mounted along the first side form to power the hydraulic motor and, further comprising a cart mounting a hydraulic pump separate from the first side form to power the hydraulic motor.

13. A mold form for forming a molded product, comprising:

a first side form including a plurality of sections;

a plurality of parallel tracks;

a plurality of carriages mounted to the first side form for movement with the first side form, each carriage movable along a track, the first side form being supported on the carriages, each carriage having at least one wheel engaging the track, at least one of said plurality of carriages supporting each of said plurality of sections;

selected ones of said carriages each having a hydraulic motor and a drive wheel driven by the hydraulic motor, said drive wheels engaging the track on which the selected ones of said carriages is movable;

hydraulic lines mounted on the first side form and connected to the hydraulic motors in each of the selected ones of said carriages to simultaneously power the hydraulic motors to rotate the drive wheels to simultaneously move the carriages and first side form along the tracks between a first, molding position to a second, release position, the hydraulic motors moving the side form away from the molded product after the molded product has cured to allow removal of the molded product from the mold form, wherein said selected ones of said carriages further includes a spring guide mounted within the selected ones of said carriages, a spring supported within the spring guide, a wheel bracket pivotally mounted to the selected ones of said carriages and supporting the drive wheel for rotation, a first spring seat at a first end of the spring, a second spring seat at a second end of the spring, a spring stop at an end of the spring guide engaging the first spring seat and a contact bar engaging the second spring seat and the wheel bracket, the spring acting between the spring stop and the contact bar to pivot the wheel bracket to force the drive wheel into engagement with the track.

14. The mold form of claim 13 further including at least one flow divider mounted on the first side form supplying hydraulic fluid to the said hydraulic motors to facilitate simultaneous movement of the carriages and first side form.

15. The mold form of claim 13 further comprising a second side form on the opposite side of the molded product from the first side form, the second side form including a plurality of second side form sections, the second side form including a plurality of second side form carriages mounted to the second side form for movement with the second side form, each second side form carriage movable along a second side form track, the second side form being supported on the second side form carriages, each second side form carriage having at least one second side form wheel engaging the second side form track, at least one of said plurality of second side form carriages supporting each of said plurality of second side form sections;

selected ones of said second side form carriages having a second side form hydraulic motor and a second side form drive wheel driven by the second side form hydraulic motor, said second side form drive wheel engaging the second side form track on which the selected ones of said second side form carriages is movable;

second side form hydraulic lines mounted on the second side form and connected to the second side form hydraulic motors in each of the selected ones of said second side form carriages to simultaneously power the second side form hydraulic motors to rotate the second side form drive wheels to simultaneously move the second side form carriages and second side form along the second side form tracks between a first, molding position to a second, release position, the second side form hydraulic motors moving the second side form away from the molded product after the molded product has cured to allow removal of the molded product from the mold form.

16. The mold form of claim 13 wherein the hydraulic motors rotate the drive wheels through a chain drive.

17. The mold form of claim 13 wherein electric motors are substituted for said hydraulic motors and hydraulic lines.

18. The mold form of claim 13 wherein the hydraulic motors and hydraulic lines are retrofitted to an existing mold form.

* * * * *